US007194986B2

(12) United States Patent
Strauss

(10) Patent No.: US 7,194,986 B2
(45) Date of Patent: Mar. 27, 2007

(54) ACTUATOR ASSISTED BLOW-OFF ASSEMBLY TO CONTROL COOLANT FLOW IN AN INTERNAL COMBUSTION ENGINE

(75) Inventor: Sebastian Strauss, Pleasant Prairie, WI (US)

(73) Assignee: BRP US Inc., Sturtevant, WI (US)

( * ) Notice: Subject to any disclaimer, the term of this patent is extended or adjusted under 35 U.S.C. 154(b) by 7 days.

(21) Appl. No.: 10/605,620

(22) Filed: Oct. 14, 2003

(65) Prior Publication Data

US 2005/0028757 A1 Feb. 10, 2005

Related U.S. Application Data

(60) Provisional application No. 60/481,189, filed on Aug. 7, 2003.

(51) Int. Cl.
*F01P 7/14* (2006.01)

(52) U.S. Cl. ..... 123/41.54

(58) Field of Classification Search ..... 123/41.54, 123/41.27, 41.15, 41.8
See application file for complete search history.

(56) References Cited

U.S. PATENT DOCUMENTS 4,167,159 A * 9/1979 Warman ..... 123/41.08
4,461,342 A * 7/1984 Avrea ..... 165/104.32
4,574,747 A * 3/1986 Hirano ..... 123/41.27
5,257,661 A * 11/1993 Frech et al. ..... 165/104.32
5,381,762 A * 1/1995 Evans ..... 123/41.54
5,836,269 A * 11/1998 Schneider ..... 123/41.1
6,666,175 B2 * 12/2003 Wand et al. ..... 123/41.01
6,679,201 B2 * 1/2004 Murakami et al. ..... 123/41.1
6,732,678 B2 * 5/2004 Lin et al. ..... 123/25 R
6,776,126 B2 * 8/2004 Le Lievre et al. ..... 123/41.54

* cited by examiner

*Primary Examiner*—Stephen K. Cronin
(74) *Attorney, Agent, or Firm*—Osler, Hoskin & Harcourt LLP

(57) ABSTRACT

A blow-off valve assembly for an internal combustion engine cooling system is biased to prevent coolant flow from the cooling system to the internal combustion engine when a pressure of the coolant is below a threshold. An actuating assembly is configured to impart a force on the blow-off valve sufficient to overcome the bias of the blow-off valve assembly when pressure of the coolant is insufficient to open the blow-off valve assembly. An engine control unit (ECU) is configured to determine if engine operating conditions warrant activation of the actuating assembly to unseat the blow-off valve if coolant pressure is below the threshold and, if so, transmit an actuating command signal to the actuating assembly to open the blow-off valve.

19 Claims, 3 Drawing Sheets

ACTUATOR ASSISTED BLOW-OFF ASSEMBLY TO CONTROL COOLANT FLOW IN AN INTERNAL COMBUSTION ENGINE

CROSS REFERENCE To RELATED APPLICATIONS

The present application claims the benefit of U.S. Ser. No. 60/481,189 filed Aug. 7, 2003.

BACKGROUND OF INVENTION

The present invention relates generally to an internal combustion engine temperature control and, more particularly, to an apparatus and method for controlling temperature of an outboard marine engine using a solenoid assisted blow-off valve.

It is well known that most internal combustion engines use a pressurized cooling system to dissipate heat generated by the combustion process. The cooling system circulates liquid coolant through a coolant jacket which surrounds certain parts of the engine. The heat is transferred from the engine to the coolant in the jacket so as to substantially maintain engine temperature at a predetermined optimum or ideal value. While it is critical not to overheat the engine, it is equally important to maintain higher operating temperatures to minimize exhaust emissions. Further, it is generally understood that engines run more efficiently at fairly high temperatures. To minimize exhaust emissions, optimal control of engine and spark plug temperature is essential. Engine temperature also affects the viscosity of oil used to lubricate the engine. At a lower viscosity, engine parts move more freely, the engine uses less energy, and engine life is therefore extended.

Conventional engine temperature control system thermostats work in conjunction with blow-off valves to regulate engine temperature. The thermostat is configured to open and close based on temperature of coolant circulating through the engine. When the coolant reaches a predetermined temperature, the position of the thermostat changes. For example, when a thermostat is in a closed position, coolant is circulated back to the pump and allowed to be re-circulated through the system. In contrast, when the thermostat is in an open position, the coolant temperature has exceeded the predetermined threshold and therefore coolant is deposited or returned to the coolant source whereupon the pump will then draw additional coolant from the coolant source and circulate the newly acquired coolant through the cooling system. In this regard, coolant having an excessive temperature is replaced by cooler coolant.

To improve fuel efficiency as well as reduce emissions, the thermostat is typically set at a temperature such that the engine is allowed to reach a relatively high ideal operating temperature. However, as engine speed increases, the thermostat can no longer adequately control engine temperature. As such, a blow-off valve or valves are used to allow coolant circulation back to the coolant source when pressure in the cooling system exceeds a predetermined value, regardless of temperature. Blow-off valves typically include a spring that places a biasing force on a head of a valve to maintain the valve in a closed position until cooling system pressure exceeds this biasing force and thereby unseats the head and allows coolant flow through the valve.

Pressure in the cooling system is typically a function of the speed by which the pump circulates coolant through the system. Generally, the pump is driven by the engine and therefore pumps coolant as a function of engine speed. For outboard motors, this arrangement typically results in the blow-off valve opening when the engine speed is approximately 1500 RPM. A drawback of this configuration however is that at mid-range engine speeds, i.e., 1500–2500 RPM, the blow-off valve opens and prevents the engine from running at higher temperatures, thereby negatively affecting emissions. However, it is not sufficient to simply increase the temperature threshold of the thermostat to run the engine at hotter temperatures and increase the pressure threshold of the blow-off valve to increase the cooling system pressure required for blow-off. Such a configuration fails to consider an engine running at lower engine speeds and higher loads. In this range, the increased load on the engine will cause an increase in an engine temperature that cannot be fully accommodated through thermostatic control of coolant circulation. Moreover, because the engine speed is relatively low, the pump is being driven at a speed insufficient to cause a build-up in pressure in the cooling system. As a result, the engine can run too hot and overheat. This linear relationship between thermostat control and blow-off valve control of a conventional system is illustrated in FIG. 1. As indicated, because conventional blow-off valves do not allow engine temperature control as a function of engine load, it is not possible to run the engine hot at mid-range speeds and low loads without over-heating the engine at higher loads for the same speed.

It would therefore be desirable to design a blow-off valve assembly that allows the engine to run at increased temperatures at higher engine speeds that also can be opened when pressure in the cooling system is insufficient to open the valve thereby allowing the engine to run at desirable high temperatures at low speed and low load while preventing overheating when the temperature of the engine cannot be thermostatically controlled.

BRIEF DESCRIPTION OF INVENTION

The present invention solves the aforementioned problems by providing a blow-off valve assembly that includes an actuator to activate the valve under certain conditions when coolant pressure is insufficient to open the valve. More particularly, the present invention includes a blow-off valve assembly wherein the force or bias imparted on the blow-off valve is increased such that increased pressure in the engine cooling system is required to open the valve. The blow-off valve assembly includes an electro-mechanical actuator or plunger that electro-mechanically opens the blow-off valve to allow coolant to pass therethrough when pressure in the cooling system alone is insufficient to open the valve. In this regard, the blow-off valve assembly allows the engine to run at hotter, ideal temperatures at low speed/low load, but also prevents overheating of the engine at low speed/high load operating conditions.

Accordingly, one aspect of the present invention includes a blow-off valve assembly having a valve body and a blow-off valve disposed in the valve body and configured to control coolant flow through an engine based on coolant pressure. An actuator is disposed in the valve body and is configured to electro-mechanically actuate the valve under certain conditions independent of coolant pressure.

In accordance with another aspect of the invention, an outboard motor includes an internal combustion engine and a cooling system to circulate coolant about the internal combustion engine to control engine temperature. A blow-off valve assembly is biased to seal the cooling system when a pressure of the coolant is below a threshold. An electro-mechanical actuating assembly is configured to impart a force on the blow-off valve sufficient to overcome the bias of the blow-off valve assembly. An engine control unit (ECU) is configured to determine if engine operating conditions warrant activation of the actuating assembly when coolant pressure is below the threshold and, if so, transmit an actuating command signal to the actuating assembly to open the blow-off valve.

In accordance with yet another aspect of the invention, a method is provided for controlling temperature of an outboard marine engine. The method includes the steps of thermostatically regulating engine temperature when the engine is operating under a first set of conditions, electro-mechanically opening a blow-off valve to reduce coolant pressure in a coolant system when the engine is operating under a second set of conditions, and hydraulically opening the blow-off valve to reduce coolant pressure in the coolant system when the engine is operating under a third set of conditions. By way of example and not limitation, the first set of conditions may be defined by engine temperature, the second set of conditions may be defined by at least engine load, and the third set of conditions may be defined by at least coolant pressure.

Various other features, objects and advantages of the present invention will be made apparent from the following detailed description and the drawings.

BRIEF DESCRIPTION OF DRAWINGS

The drawings illustrated the best mode presently contemplated for carrying out the invention.

In the drawings.

DETAILED DESCRIPTION

Figure 2:
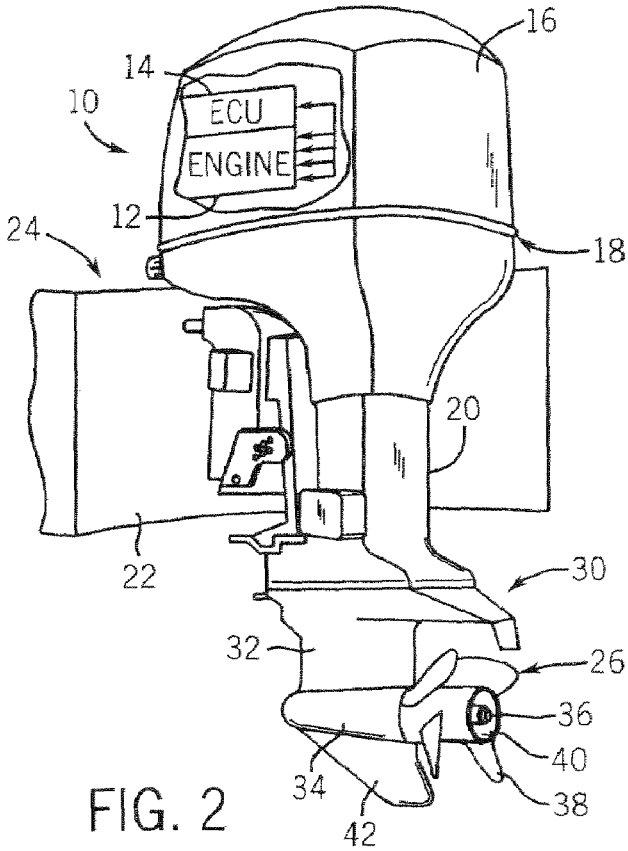
FIG. 2 is an exemplary outboard motor incorporating the present invention.

The present invention relates generally to internal combustion engines, and preferably, those incorporating direct fuel injection in a spark-ignited two-cycle gasoline-type engine. FIG. 2 shows an outboard motor 10 having one such engine 12 controlled by an electronic control unit (ECU) 14 under engine cover 16. Engine 12 is housed generally in a powerhead 18 and is supported on a mid-section 20 configured for mounting on a transom 22 of a boat 24 in a known conventional manner. Engine 12 is coupled to transmit power to a propeller 26 to develop thrust and propel boat 24 in a desired direction. A lower unit 30 includes a gear case 32 having a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via mid-section 20. A skeg 42 depends vertically downwardly from torpedo section 34 to protect propeller fins 38 and encourage the efficient flow of outboard motor 10 through water.

While the present invention is shown as being incorporated into an outboard motor, the present invention is equally applicable with many other applications, some of which include inboard motors, snowmobiles, personal watercrafts, all-terrain vehicles (ATVs), motorcycles, mopeds, lawn and garden equipment, generators, etc.

Figure 3:
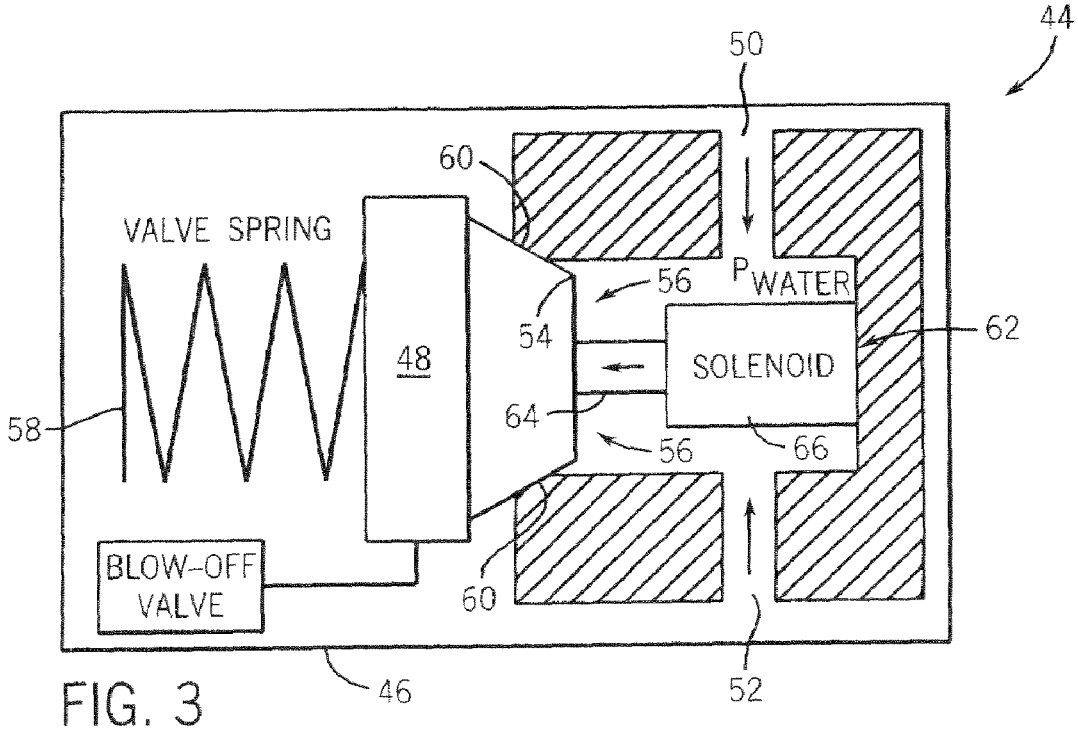
FIG. 3 is a schematic diagram, partially in section, of a blow-off valve assembly embodying various features of the present invention.

FIG. 3 shows a blow-off valve assembly 44 in accordance with the present invention. The valve assembly 44 includes a valve body 46 and a blow-off valve 48 which is disposed in the valve body 46. The valve body 46 also preferably has two coolant inlet ports 50 and 52, which are configured to receive pressurized coolant circulating through a cooling system. The blow-off valve assembly 44 is configured to control pressure of a cooling system for a marine engine, located in the outboard motor 10, based on coolant pressure or, as will be described, may be controlled electro-mechanically when pressure in the cooling system is not sufficient to open the valve. Valve 48 of blow-off valve assembly 44 has a conical end 54 that is configured to extend axially to seal a coolant path 56 of the cooling system. The valve assembly 44 includes a spring 58 configured to bias the valve 48 against a seat 60 of the valve body 46 to close coolant path 56. When the pressure in the cooling system is sufficient to overcome the bias placed on the valve 48 by the spring 58, the blow-off valve opens and allows coolant to pass through path 56. As a result, fresh coolant can enter the system.

As noted above, pressure in the cooling system is a function of engine speed. That is, the speed of the engine drives a pump (not shown) which delivers coolant from a coolant source to the cooling system. For outboard motor applications, the coolant source is typically the water in which the motor is disposed. Under certain conditions, such as low engine speed/high load, the pump may not be sufficiently driven to increase cooling system pressure to a level sufficient to unseat valve 48 from seat 60. Accordingly, an actuator assembly 62 is disposed in the valve body 46 and is designed to engage the blow-off valve 48 so that the valve 48 is caused to open under such conditions. Actuator assembly 62 is configured to electro-mechanically open the valve 48 under certain conditions independent of cooling system pressure. The actuator assembly 62 includes a plunger 64 controlled by a solenoid 66 to impart a force on valve 48 sufficient to overcome the bias of spring 58. Solenoid 66 is controllable by an engine control unit (ECU) as will next be described.

Figure 4:
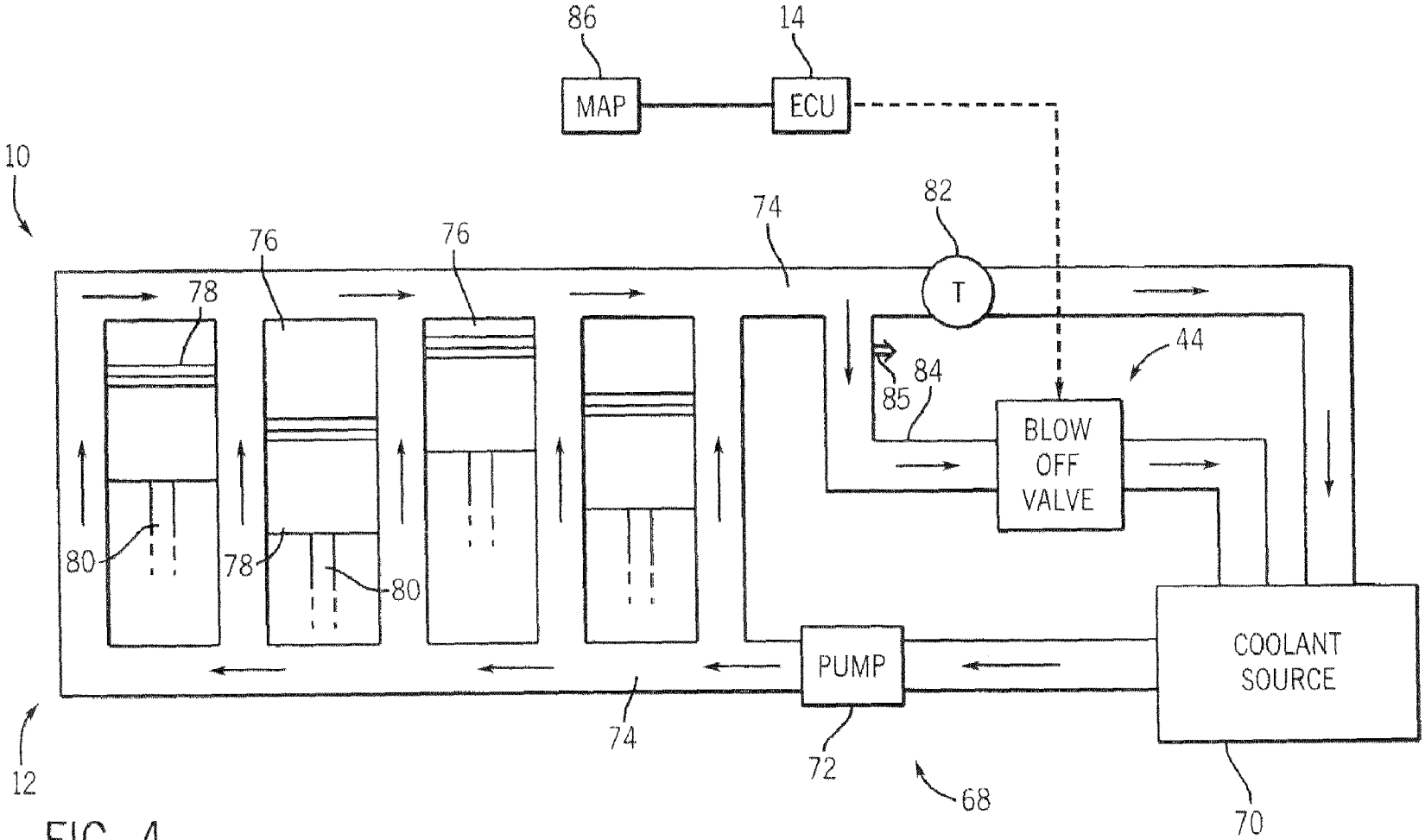
FIG. 4 is the schematic diagram of an engine temperature control system employing the blow-off valve in accordance with a preferred embodiment of the present invention.

FIG. 4 is the schematic diagram of an engine temperature control system employing the blow-off valve assembly 44 in accordance with one embodiment of the present invention. The outboard motor 10 includes an internal combustion engine 12 and a cooling system 68 to circulate coolant from a cooling source 70 to regulate the temperature of the internal combustion engine 12. Coolant pump 72 draws coolant from the coolant source 70 and circulates coolant through coolant passages 74 of cooling system 68. Coolant passages 74 circulate coolant about a plurality of cylinders 76 of engine 12. A piston 78 reciprocates in each of the cylinders 76 and is connected to a crankshaft (not shown) by a connecting rod 80. Coolant within coolant passages 74 transfers heat generated from the combustion process away from cylinders 76. If the coolant temperature is above a desired threshold, thermostat 82 allows coolant to flow back to coolant source 70. Pump 72 will then draw fresh coolant from coolant source 70 to replace the discharged coolant. Blow-off valve assembly 44 is disposed in a circulation path 84 and is biased in a closed position such that coolant circulating around engine 12 is discharged from cooling system 68 through a discharge orifice 85 when pressure in the coolant passages 74 is below a threshold, i.e. insufficient to unseat the valve. Discharge orifice 85 can be constructed to provide cooling flow to other engine system components such as the ECU and a tell-tale indicator (not shown).

As noted above, blow-off valve assembly 44 includes an actuating assembly configured to impart a force on the blow-off valve 48 sufficient to overcome the bias of the blow-off valve assembly 44 when actuated by ECU 14. In one embodiment, ECU 14 controls actuation of valve assembly 44 based on data stored in a map or look-up table 86. The ECU 14 determines when the actuating assembly should be activated from a comparison of actual engine speed and load with the predefined map 86 of engine speed and load data. In any case, ECU 14 is configured to determine if the engine operating conditions warrant activation of the actuating assembly 62 to unseat the blow-off valve 48 if coolant pressure is below a threshold and engine speed is above another threshold, or in general, to maintain a high operating temperature to minimize emission in all operating ranges. When ECU 14 activates valve assembly 44, ECU 14 transmits an actuating command signal to the internal solenoid to open the blow-off valve 48 and allow coolant to pass to coolant source 70 thereby dropping the pressure in the coolant paths 74 and maintaining engine temperature. The ECU is configured to transmit the actuating command signal to the solenoid controlled plunger based on engine speed and engine load such that a target engine temperature is maintained. The ECU is programmed to then regulate the actuating assembly to maintain a desired engine temperature.

Figure 1:
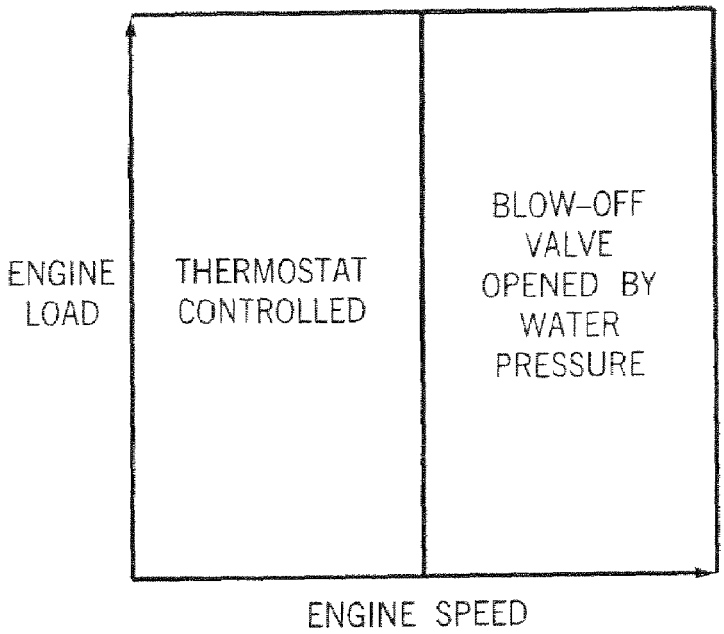
FIG. 1 PRIOR ART
FIG. 1 is a graph illustrating a blow-off valve operation according to the prior art.
Figure 5:
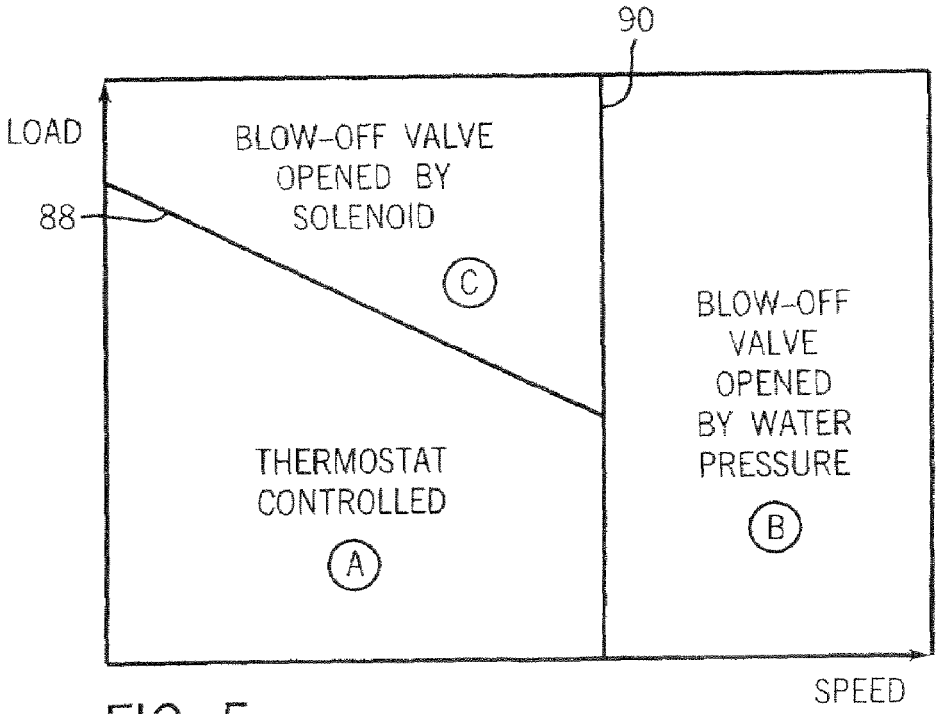
FIG. 5 is a graph illustrating a blow-off valve operation according to the present invention.

FIG. 5 is a graph which illustrates the operation of the blow-off valve assembly 44 to control temperature of the engine in accordance with the present invention. The graph depicts operation of the blow-off valve as a function of engine load and speed. The operation of the system is divided into three regions A, B, and C by lines 88 and 90 based on a given engine load and engine speed. Region A is a low speed/low load region and can therefore be controlled thermostatically in a conventional manner using one or more thermostats of a given temperature threshold. Region B is a high speed/high load region where the engine temperature can effectively be controlled by hydraulically opening the blow-off valve when coolant pressure in the coolant system is sufficient to unseat the blow-off valve. As engine speed increases, the speed by which the coolant pump circulates coolant through the cooling system also increases. To prevent a dead-head condition in the cooling system, the blow-off valve opens to allow coolant to escape the system thereby dropping the pressure of the coolant in the system as well as the temperature of the engine through an inrush of cooler coolant.

Region C however is a low speed/high load hybrid region where the engine temperature is controlled electro-mechanically with the solenoid-actuated plunger by opening the blow-off valve to reduce pressure in the cooling system when the speed of the engine is not high enough to exert the pressure necessary to blow-open the blow-off valve 48. Electro-mechanically opening the blow-off valve is advantageous under engine operating conditions wherein engine speed is insufficient to drive the water pump to increase pressure in the cooling system to a level sufficient to open the blow-off valve. When engine speed is set to a level below line 90 and engine load is increased above line 88, the engine temperature will increase thereby causing an increase in coolant temperature and pressure in the cooling system, but the increase is not sufficient to hydraulically open the blow-off valve. Under these conditions, typically associated with low engine speed and high engine load, the blow-off valve is opened electro-mechanically.

Accordingly, one embodiment of the present invention includes a blow-off valve assembly having a valve body and a blow-off valve disposed in the valve body and configured to control coolant flow through an engine based on coolant pressure. An actuator is disposed in the valve body and is configured to electro-mechanically actuate the valve under certain conditions independent of coolant pressure.

In accordance with another embodiment of the invention, an outboard motor includes an internal combustion engine and a cooling system to circulate coolant about the internal combustion engine to control engine temperature. A blow-off valve assembly is biased to seal the cooling system when a pressure of the coolant is below a threshold. An electro-mechanical actuating assembly is configured to impart a force on the blow-off valve sufficient to overcome the bias of the blow-off valve assembly. An engine control unit (ECU) is configured to determine if engine operating conditions warrant activation of the actuating assembly when coolant pressure is below the threshold and, if so, transmit an actuating command signal to the actuating assembly to open the blow-off valve.

In accordance with yet another embodiment of the invention, a method is provided for controlling temperature of an outboard marine engine. The method includes the steps of thermostatically regulating engine temperature when the engine is operating under a first set of conditions, electro-mechanically opening a blow-off valve to reduce coolant pressure in a coolant system when the engine is operating under a second set of conditions, and hydraulically opening the blow-off valve to reduce coolant pressure in the coolant system when the engine is operating under a third set of conditions. By way of example and not limitation, the first set of conditions may be defined by engine temperature, the second set of conditions may be defined by at least engine load, and the third set of conditions may be defined by at least coolant pressure.

The present invention has been described in terms of the preferred embodiment, and it is recognized that equivalents, alternatives, and modifications, aside from those expressly stated, are possible and within the scope of the appending claims.

What is claimed is:

1. A blow-off valve assembly comprising:

a valve body;

a blow-off valve disposed in the valve body; and an actuator disposed in the valve body and configured to electro-mechanically activate the valve under certain conditions independent of coolant pressure, at least when the coolant pressure is below a threshold;

wherein the blow-off valve is configured to:

prevent coolant flow when the coolant pressure is below the threshold; and allow coolant flow when the coolant pressure is above the threshold, independently of the actuator.

2. The valve assembly of claim 1 wherein the valve includes a conical end and is configured to extent axially to seal a coolant path of a cooling system.

3. The valve assembly of claim 2 wherein the valve further comprises a spring connected to another end of the valve and is configured to bias the valve against a seat of the valve body to seal the coolant path.

4. The valve assembly of claim 3 wherein the actuator includes a plunger connected to the valve body configured to unseat the valve under the certain conditions.

5. The valve assembly of claim 4 wherein the plunger includes an electro-mechanical solenoid controllable by an engine control unit (ECU) to impart a force on the valve to overcome a bias placed on the valve.

6. The valve assembly of claim 5 wherein the ECU activates the electro-mechanical solenoid based on engine load and speed.

7. The valve assembly of claim 1 wherein the valve body further includes at least one inlet port configured to receive pressurized coolant circulating through a cooling system.

8. The valve assembly of claim 1 wherein the engine is disposed in an outboard motor.

9. An outboard motor comprising:

an internal combustion engine;

a cooling system having a number of coolant passages to circulate coolant about the internal combustion engine;

a blow-off valve disposed in a coolant passage, biased to seal the coolant passage when a pressure of the coolant is below a threshold;

an electro-mechanical actuating assembly configured to impart a force on the blow-off valve sufficient to overcome the sealing bias of the blow-off valve, and open the coolant passage, at least when the pressure of the coolant is below the threshold; and an ECU configured to activate the electro-mechanical actuating assembly to maintain a desired operating temperature;

when the coolant pressure is above the threshold, the sealing bias of the blow-off valve is overcome, opening the coolant passage independently of the electro-mechanical actuating assembly.

10. The outboard motor of claim 9 wherein the ECU activates the electro-mechanical actuating assembly to unseat the blow-off valve if coolant pressure is below the threshold and, if so, transmit an actuating commence signal to the actuating assembly to open the blow-off valve.

11. The outboard motor of claim 10 wherein the actuating assembly includes a solenoid controlled plunger and the ECU is further configured to transmit the actuating command signal to the solenoid controlled plunger based on engine speed and engine load.

12. The outboard motor of claim 11 wherein the ECU is further configured to compare an actual engine speed and load with a predefined map of engine speed and load data.

13. The outboard motor of claim 9 wherein the ECU is further configured to transmit the actuating command signals to the actuating assembly to maintain a relatively constant engine temperature for a specific engine speed and load.

14. The outboard motor of claim 9 wherein the ECU is further configured to regulate the actuating assembly such that a maximum engine temperature is not exceeded.

15. A method of controlling the temperature of an outboard marine engine comprising the steps of:

thermostatically regulating engine temperature when the engine is operating under a first set of conditions;

electro-mechanically opening a blow-off valve to reduce engine temperature when the engine is operating under a second set of conditions; and hydraulically opening the blow-off valve to reduce coolant pressure in the coolant system when the engine is operating under a third set of conditions;

wherein the first set of conditions is defined by an engine temperature, the second set of conditions is defined by at least engine load, and the third set of conditions is defined by at least coolant pressure.

16. The method of claim 15 wherein the step of electro-mechanically opening the blow-off valve includes the step of actuating an electro-mechanical solenoid designed to impart a force on the blow-off valve sufficient to unseat the blow-off valve.

17. The method of claim 16 further comprising the step of actuating the electro-mechanical solenoid by transmitting control signals based on engine speed and load.

18. The method of claim 15 further comprising the step of comparing instantaneous engine operating conditions to a look-up table of data detailing under what engine operating conditions the blow-off valve should be electro-mechanically opened.

19. The method of claim 15 wherein the second set of conditions includes an engine speed of at least 2500 PRM.

* * * * *